US006412390B1

(12) United States Patent
Dindl

(10) Patent No.: US 6,412,390 B1
(45) Date of Patent: Jul. 2, 2002

(54) LOW IMPULSE FIRING ADAPTER FOR COMBINATION GAS AND RECOIL OPERATED WEAPONS

(76) Inventor: Frank J. Dindl, 79 Pine St., Wharton, NJ (US) 07885

( * ) Notice: Subject to any disclaimer, the term of this patent is extended or adjusted under 35 U.S.C. 154(b) by 0 days.

(21) Appl. No.: 09/632,008

(22) Filed: Aug. 3, 2000

Related U.S. Application Data

(60) Provisional application No. 60/149,860, filed on Aug. 20, 1999.

(51) Int. Cl.[7] ..... F41A 21/10

(52) U.S. Cl. ..... 89/14.5; 89/28.2; 89/159; 89/191.01; 89/191.02; 42/76.01; 42/76.02

(58) Field of Search ..... 89/14.5, 28.2, 89/159, 191.01, 191.02; 42/77, 76.02, 76.01

(56) References Cited

U.S. PATENT DOCUMENTS

| | | | | |
|---|---|---|---|---|
| 2,805,602 | A | * 9/1957 | Moore | 89/14 |
| 2,956,481 | A | * 10/1960 | Barr et al. | |
| 3,742,640 | A | * 7/1973 | Thomsen | 42/76 R |
| 3,776,095 | A | * 12/1973 | Atchisson | |
| 4,019,423 | A | * 4/1977 | Johnson | 89/178 |
| 4,404,765 | A | * 9/1983 | Reudelsterz et al. | 42/77 |
| 4,475,438 | A | * 10/1984 | Sullivan | 89/191 R |
| 4,686,905 | A | * 8/1987 | Szabo | |
| 5,983,772 | A | * 11/1999 | Reynolds et al. | |
| 6,026,728 | A | * 2/2000 | Guhring et al. | 89/14.5 |
| 6,293,203 | B1 | * 9/2001 | Alexander et al. | |
| 6,357,331 | B1 | * 3/2002 | Dionne | |

FOREIGN PATENT DOCUMENTS

| | | | |
|---|---|---|---|
| GB | 235863 | * | 2/1926 |

* cited by examiner

*Primary Examiner*—Charles T. Jordan
*Assistant Examiner*—John Richardson
(74) *Attorney, Agent, or Firm*—John F. Moran; Michael C. Sachs

(57) ABSTRACT

A low impulse firing attachment and companion ammunition for combination gas and recoil operated automatic weapons is comprised of a barrel insert and piston that provide the mechanism for containing the expanding propellant gases produced on firing. Such mechanism provides the required gas pressure at the gas port of the weapon to power the gas system. The barrel insert also allows the use of a sub-caliber piston for the propellant gases to act against. The gas pressure forces the barrel and piston apart, accelerating the recoiling mass rearward to provide recoil operation. The sub-caliber piston allows the use of the relatively high gas port pressure while limiting the peak force transmitted through the adapter. The blank and adapter provide the appropriate gas pressure at the gas port to power the gas system. The adapter also acts as a piston inside the barrel so that the gas pressure forces the barrel rearward, which provides the recoil operation. The adapter is anchored to the receiver, so the loads generated during firing are transmitted through the adapter to the receiver. A barrel insert acts as a sleeve so that the piston can be smaller in diameter than the bore. This allows the use of the same gas pressure required at the gas port for gas system powering to also push against the piston to provide recoil operation while transmitting a manageable peak load through the adapter to the receiver.

16 Claims, 15 Drawing Sheets

130
500
470
132
200

460
140

430
420
490
410
125
110
170
160
180
480
220
400
100
150
300

141

450

LOW IMPULSE FIRING ADAPTER FOR COMBINATION GAS AND RECOIL OPERATED WEAPONS

RELATED APPLICATIONS

This application claims benefit of filing date Aug. 20, 1999 of provisional application Ser. No. 60/149,860, the entire file wrapper contents of which application are herewith incorporated by reference as though fully set forth herein at length.

GOVERNMENT INTEREST

The invention described herein may be manufactured and used by, or for the Government of the United States for governmental purposes without the payment of any royalties thereon.

FIELD OF THE INVENTION

The present invention relates in general to the field of blank firing adapters and other low impulse firing adapters for automatic weapons. More specifically, the present invention relates to automatic weapons that feature a combination of gas and recoil operation.

BACKGROUND OF THE INVENTION

Reduced cartridge impulses provided by lower mass projectile systems and/or reduced chamber pressure will result in reduced operating energy in the gun system. Consequently, the weapon cyclic rate will be reduced to the point of non-function. Exemplary low impulse cartridges that produce much lower impulse levels than required to function weapons in the fully automatic mode, include blanks, limited range training ammunition, and non-lethal cartridges. All of these cartridges have high value for training and non-lethal operations, and a mechanism of operating the weapon realistically whilst firing these low impulse munitions is highly desired.

There is a great and still unsatisfied seed for a low impulse firing adapter for use in a combination gas and recoil operated automatic weapon.

SUMMARY OF THE INVENTION

Blank cartridges, limited range training rounds, non-lethal cartridges and other low impulse cartridges will not function automatic weapons that rely on both ammunition recoil impulse and gas pressure. Combination gas and recoil operated weapons use gas pressure bled from the barrel during firing to power the gas system, while the ammunition recoil impulse provides the energy for recoil operation.

One feature of the present invention is to satisfy this long felt need by providing a low impulse adapter for use in a combination gas and recoil operated automatic weapon.

Another feature of the present invention is to provide an adapter configuration that accelerates the recoiling masses and at the same time provides a mechanism to pressurize the gas system. This allows for the launching of low velocity and or low mass projectiles such as a blank round while functioning combination gas and recoil operated weapons in the full automatic mode.

The present invention solves this problem by using a barrel insert that provides a mechanism for producing the necessary gas pressure at the gas port, while also providing a gas piston mechanism to force the recoiling masses rearward.

The present invention also provides a barrel insert or sleeve that allows the piston diameter to be smaller than the barrel bore diameter, in order to provide a force transmitted to the receiver below the level that would damage the receiver.

A further feature of the present invention, is to provide a fully automatic weapon function without requiring changes to the weapon itself, while permitting effective firing of reduced impulse munitions.

These and other features and advantages of the invention are achieved by a low impulse adapter and companion low cost blank ammunition. Projected savings associated with using low cost blank ammunition of the present invention in lieu of combat ammunition will be significant.

This invention also allows firing of low cost training cartridges, limited range training cartridges, non-lethal cartridges, and other reduced impulse/low impulse cartridges for combination gas and recoil operated weapons.

Two possible configurations of the blank cartridge are illustrated herein. One embodiment is comprised of a hollow assembly with forward crimp and contained within the cartridge proper is a commercial .44 caliber blank cartridge or similar small caliber cartridge that has been loaded with a primer and propellant charge to provide the pressure characteristics desired in adapter operation.

The second embodiment provides an equally effective configuration, and shows the cartridge envelop containing the propellant charge that provides the desired burning and pressure characteristics. This cartridge provides the exterior characteristics required to feed through the weapon and chamber prior to firing.

The adapter is comprised of a barrel insert that is firmly affixed to the weapon barrel. The barrel insert provides the mechanism for providing the gas pressure required at the gas port while allowing the use of a sub-caliber piston to recoil the barrel and recoiling mass. The sub-caliber piston allows the loads transmitted through the adapter to the weapon receiver to be held below the level at which damage to the receiver would occur.

The operation of one embodiment of a straight recoil version of a combination gas and recoil operated weapon using the adapter of the present invention is as follows: The blank cartridge travels through the weapon feed mechanism. The outside configuration of the cartridge and the position of the link are preferably constrained to that of conventional full service ammunition in order to be compatible with the weapon. The link and cartridge are restrained during the final feed operation in a ready to feed position. As the sear is depressed in firing, the main operating springs of the weapon accelerate the bolt and bolt carrier forward. The bolt strips the cartridge from the feed mechanism. The cartridge is then chambered within the barrel. The firing pin then engages the primer of the cartridge and ignition occurs.

Upon firing, gases are generated within the blank case and gases are expelled into the barrel assembly of the weapon. These gases are constrained by the barrel insert of the adapter which leads to a pressure build up within the barrel assembly. Gas is bled off of the barrel assembly through the gas port and is used to power the gas system.

The gas pressure delivers an equal and opposite net forward thrust on the sub-caliber piston and rearward thrust upon the locked barrel assembly, accelerating the barrel rearward and powering the recoil portion of the weapon function.

The sub-caliber piston within the adapter allows for the use of the relatively high gas port pressure while limiting the peak force transmitted through the adapter to the receiver. In one embodiment, a check valve within the barrel insert prevents the gas from bleeding back into the chamber and assures that gas pressure is maintained during piston operation and barrel recoil. This arrangement may also be used to allow the chamber pressure to be bled down prior to the cartridge case extraction.

The operation of a fire-out-of-battery version of a combination gas and recoil operated weapon using the adapter of the present invention is as follows: The blank cartridge travels through the weapon feed mechanism. The outside configuration of the cartridge and the position of the link are preferably, but not necessarily, constrained to that of conventional full service ammunition, in order to be compatible with the weapon mechanism. The link and cartridge are restrained during the final feed operation in a ready to feed position as the barrel, bolt, and carriage system are restrained to the rear ready to fire position by the weapon's searing system. As the sear is depressed in firing, the operating springs of the weapon accelerate the barrel, bolt, and carriage assembly forward.

At a prescribed point, the bolt strips the cartridge from the feed mechanism. The cartridge is then chambered within the barrel. The barrel assembly then continues to accelerate forward until reaching the firing position. The firing pin then engages the primer of the cartridge and ignition occurs.

Upon firing, gases are generated within the blank case until such time as the gas pressure exceeds the crimping force of the cartridge. Gases are expelled into the barrel assembly of the weapon. These gases are constrained by the barrel insert and the piston of the adapter, which leads to a pressure build up within the barrel assembly. Gas is bled off of the barrel assembly through the gas port and is used to power the gas system. In so doing, the bolt is unlocked, the cartridge is extracted and ejected, and the bolt carriage is returned to the seared position.

The gas pressure delivers an equal and opposite net forward thrust on the sub-caliber piston and rearward thrust upon the barrel assembly delivering it fully to the rear or seared, ready to fire position. At this time the operating assembly is retained by the sear assembly or if burst firing is desired, the sear remains depressed and the weapon will continue to fire automatically until its fire is arrested by the operator or the weapon runs out of ammunition.

The sub-caliber piston within the adapter allows for the use of the relatively high gas port pressure while limiting the peak force transmitted through the adapter to the receiver. In one embodiment, a check valve within the barrel insert prevents the gas from bleeding back into the chamber and assures that gas pressure is maintained during piston operation and barrel recoil. This arrangement also allows the chamber pressure to be bled down prior to bolt unlock and cartridge case extraction.

An alternative embodiment of the present invention allows for the firing of sub-caliber projectiles such as low impulse non-lethal payloads or limited range training projectiles. Whilst these ammunitions would not normally function in combination gas and recoil operated weapons, this embodiment allows for a fully functional use of these munitions that have valuable training and tactical uses.

The present invention enables the practical and efficient use of low impulse ammunition in an unmodified combination gas and recoil operated weapon. This design is enabled by the ability of the present adapter system to use the same gas pressure within the barrel necessary to actuate the gas system whilst at the same time the adapter causes sufficient rearward thrust upon the recoiling parts to return the recoiling parts to the rear, sear position. The use of a barrel sleeve and sub-caliber piston allows the forces transmitted through the adapter to the receiver to be controlled and maintained at a practical level.

BRIEF DESCRIPTION OF THE DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and of the purpose of explanation.

DETAILED DESCRIPTION OF THE INVENTION

Figure 1:
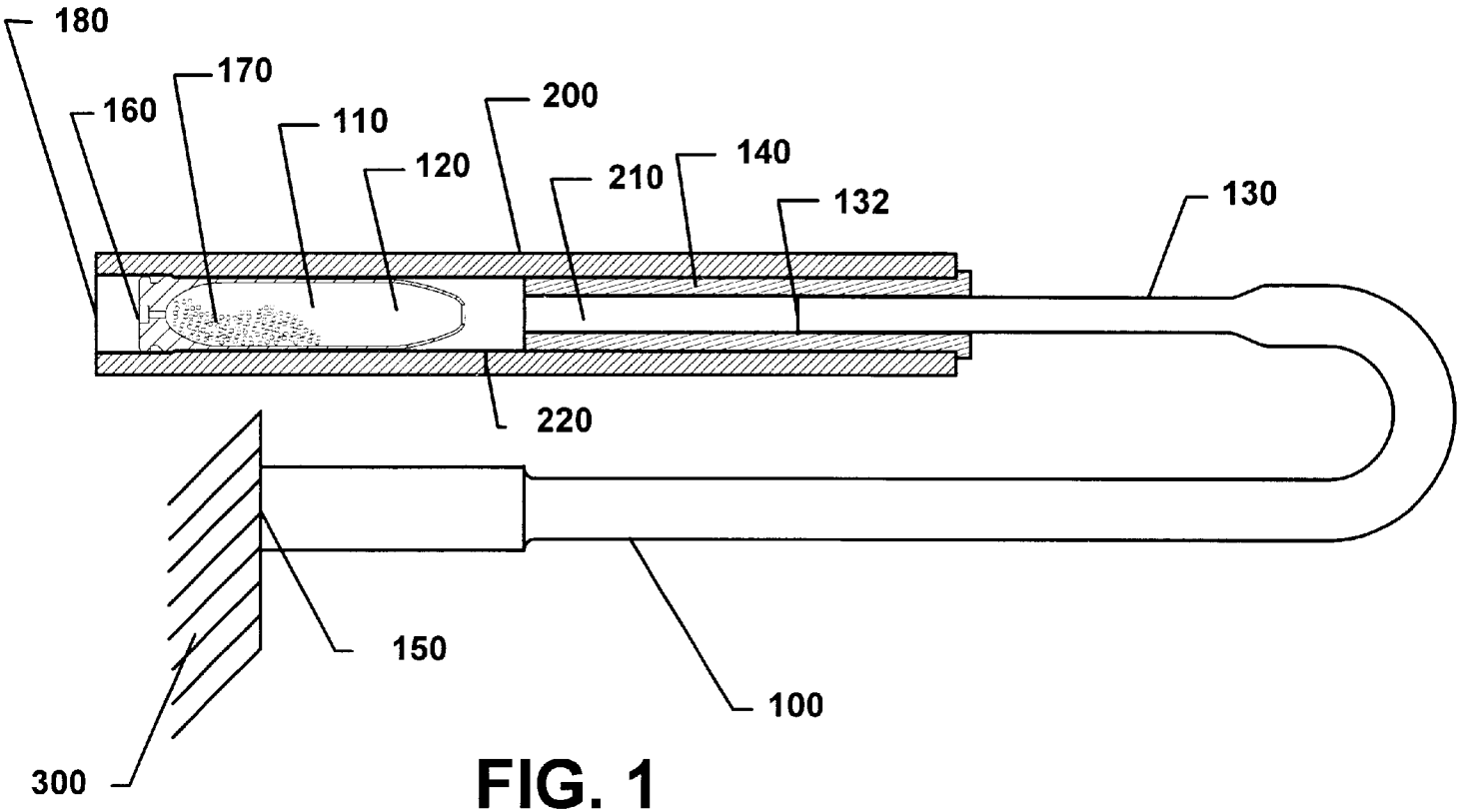
FIG. 1 is a cross-sectional, side elevational view of a low impulse adapter for firing blanks for a fire-out-of-battery version of a combination gas and recoil operated weapon illustrating a barrel in a seared, ready-to-fire (rear) position.

FIGS. 1 through 10 illustrate a low impulse adapter 100 for use in firing a low impulse cartridge 110 such as a blank cartridge 120, limited range training ammunition, non-lethal payloads, and other low impulse ammunition in a combination gas and recoil operated weapon, according to a first embodiment of the present invention. With particular reference to FIGS. 1 through 6, the adapter 100 is comprised of three main components: a piston 130, a sleeve 140, and an anchor 150.

Figure 11C:
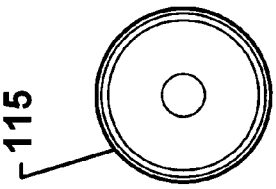
FIG. 11 is comprised of FIGS. 11A, 11B and 11C that illustrate a rear view, a side elevational view, and a front view, respectively, of the blank cartridge.
Figure 11B:
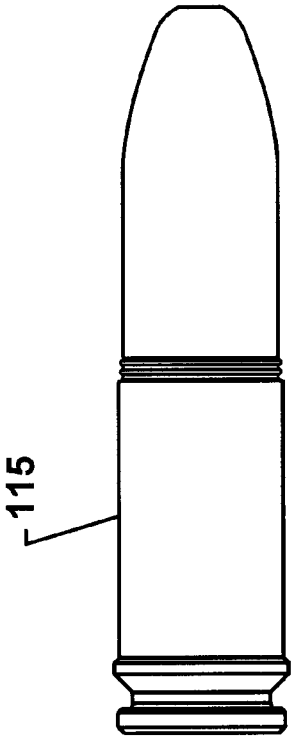
Figure 11A:
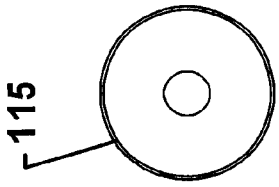
Figure 12C:
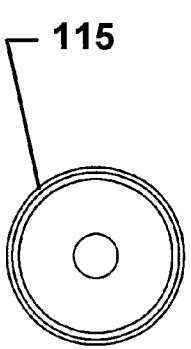
FIG. 12 is comprised of FIGS. 12A, 12B and 12C that illustrate a rear view, a cross sectional side elevational view, and a front view, respectively, of. the blank cartridge.
Figure 12B:
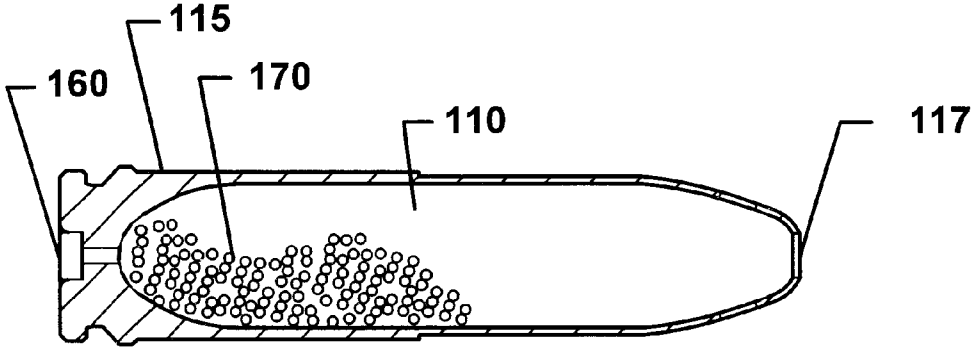
Figure 12A:
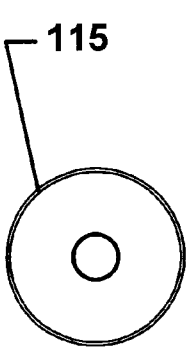
Figure 13C:
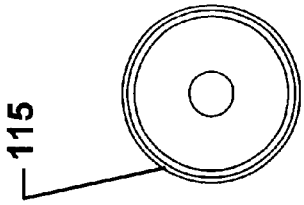
FIG. 13 is comprised of FIGS. 13A, 13B and 13C that illustrate a rear view, a cross sectional side elevational view, and a front view, respectively, of the blank cartridge with a small caliber .44 caliber or similar blank cartridge.
Figure 13B:
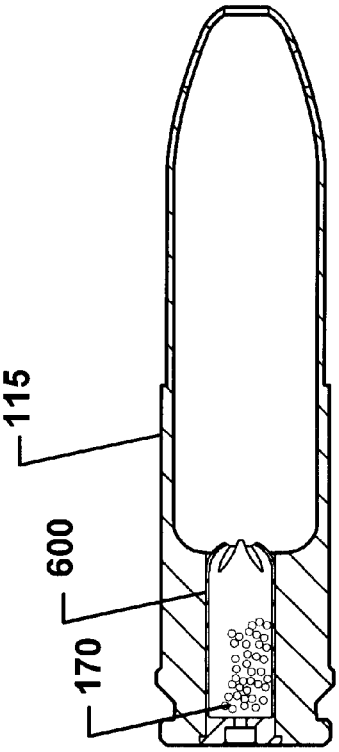
Figure 13A:
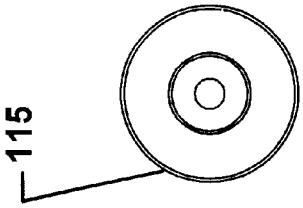

The low impulse adapter 100 achieves power for operation of the combination gas and recoil operated weapon from low impulse ammunition cartridges 110 such as are those shown in FIGS. 11 through 13. These cartridges 110 are generally comprised of a primer 160 that provides ignition, and a propellant 170 that provides the required propulsion energy. The overall outer configuration of the cartridge 110 matches the outer configuration of a conventional combination gas and recoil operated weapon cartridge where the cartridge interfaces with the weapon, to the extent necessary for reliable weapon function.

The cartridge 110 when fully locked into a chamber 180 of a barrel 200 is in a ready-to-fire condition. When firing commences, the firing pin is released by the sear of the weapon (not shown) and strikes the primer 160 of the cartridge 110.

Once the expanding gases are released, they are free to pass into the inner volume of the barrel 200 and a barrel insert inner bore 210. These expanding gases develop significant pressure which reacts with a piston surface 132 and cause a reaction at the anchor point 150 with the receiver 300. This results in a rearward reaction upon the barrel 200, which accelerates the barrel 200 and recoiling mass rearward to provide recoil operation.

Whilst the parts are recoiling, the gas pressure within the barrel 200 bleeds through a gas port 220 and into the gas system (not shown). Sufficient pressure is generated by the burning propellant to cause normal operation of the gas system (not shown).

Figure 2:
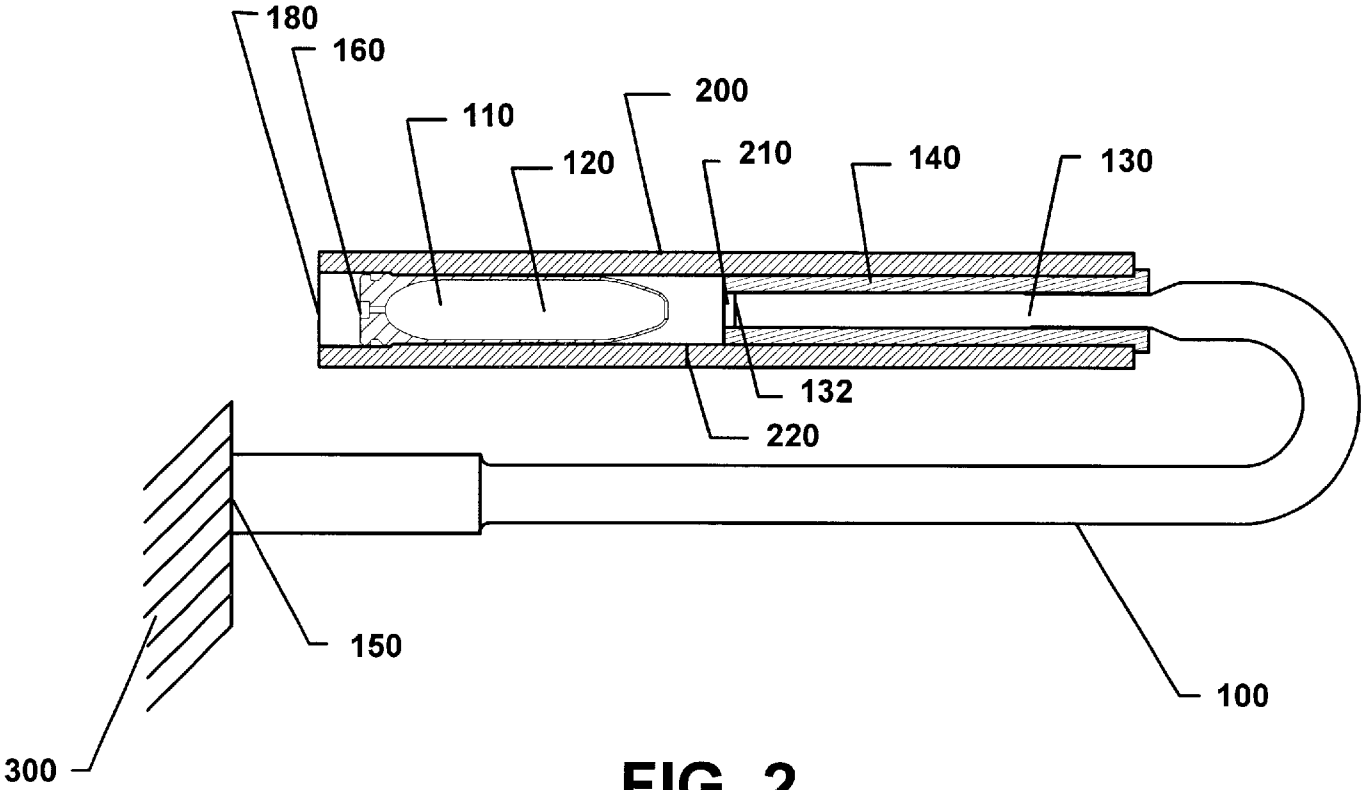
FIG. 2 is a cross-sectional, side elevational view of FIG. 1, illustrating the barrel in the fire (forward) position.
Figure 3:
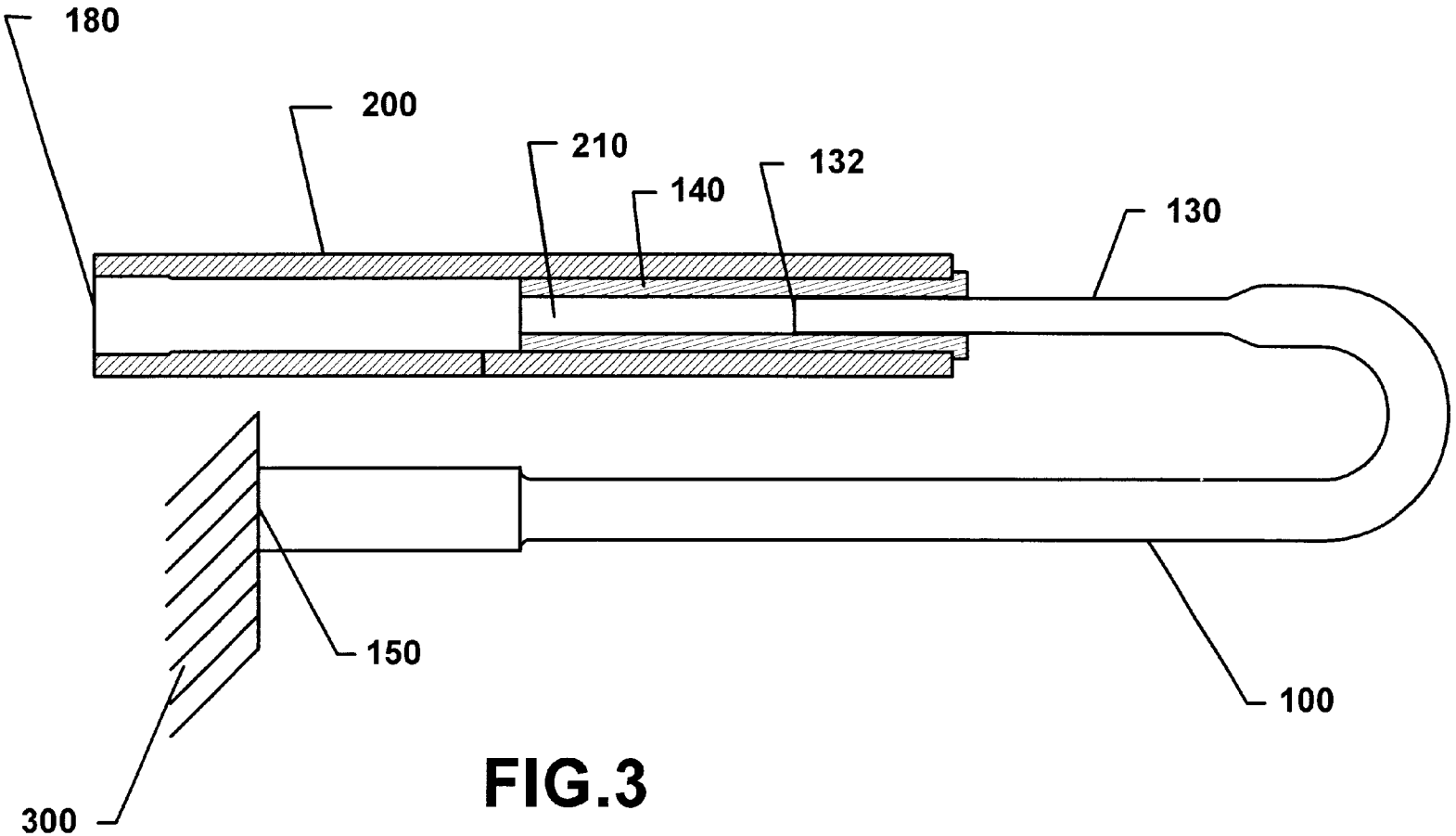
FIG. 3 is a cross-sectional, side elevational view, illustrating the barrel returned to the seared, rear position.
Figure 4:
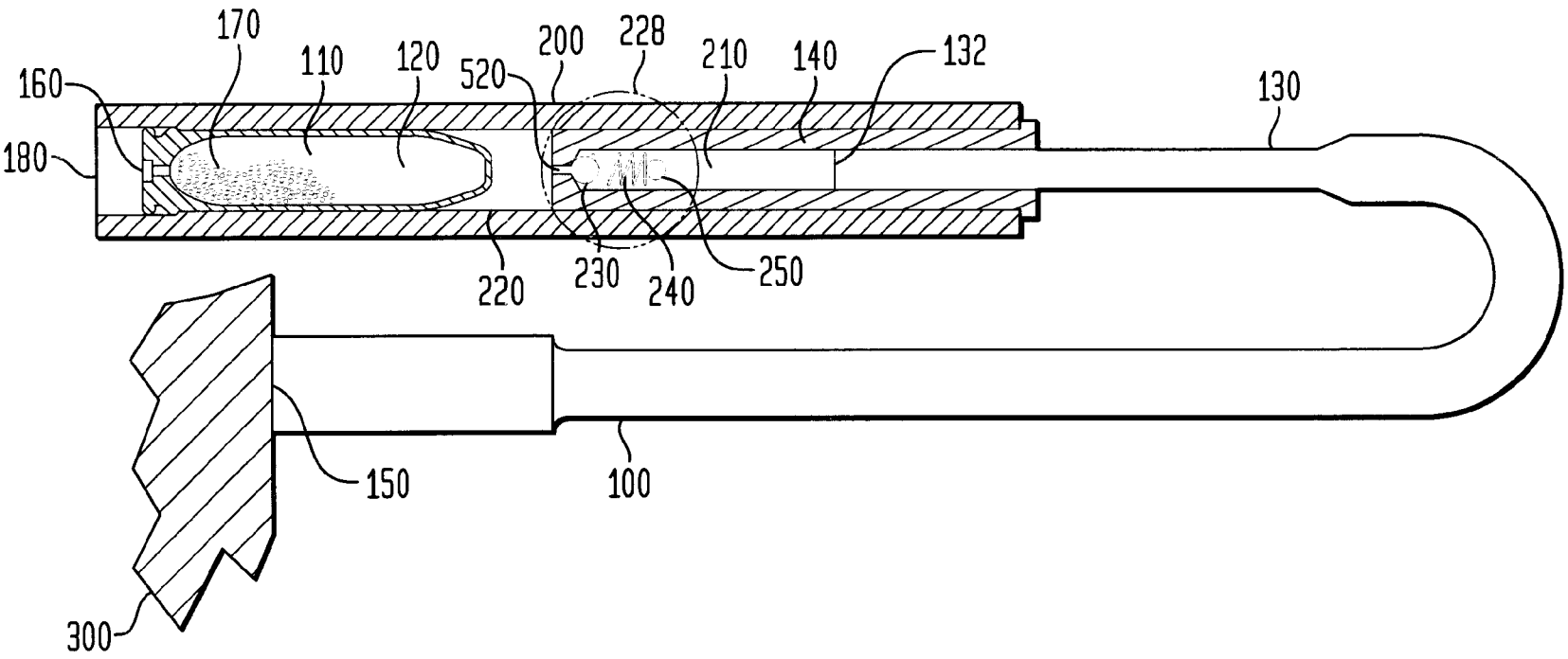
FIG. 4 through 6 are cross-sectional, side elevational views that correspond to FIGS. 1 through 3, respectively, further illustrating a valve to capture gas pressure within the blank firing adapter.
Figure 5:
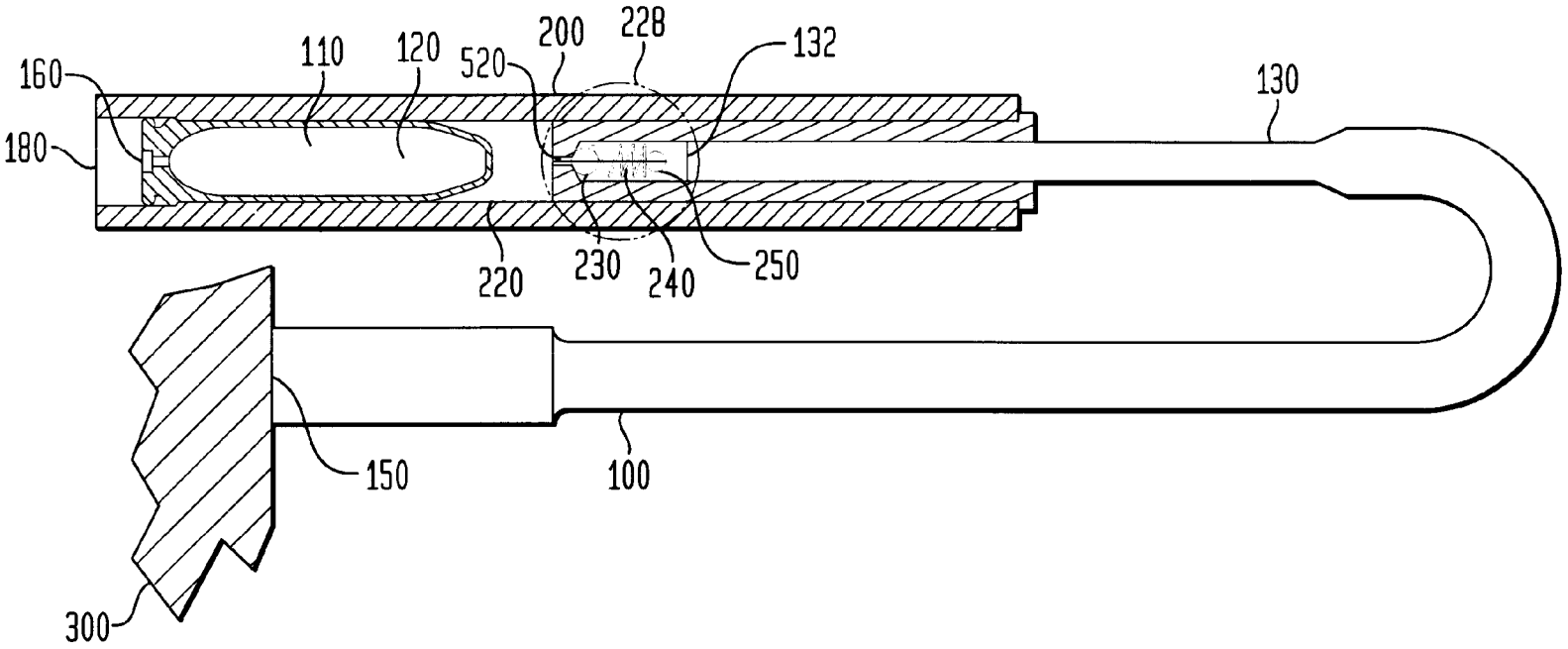
Figure 6:
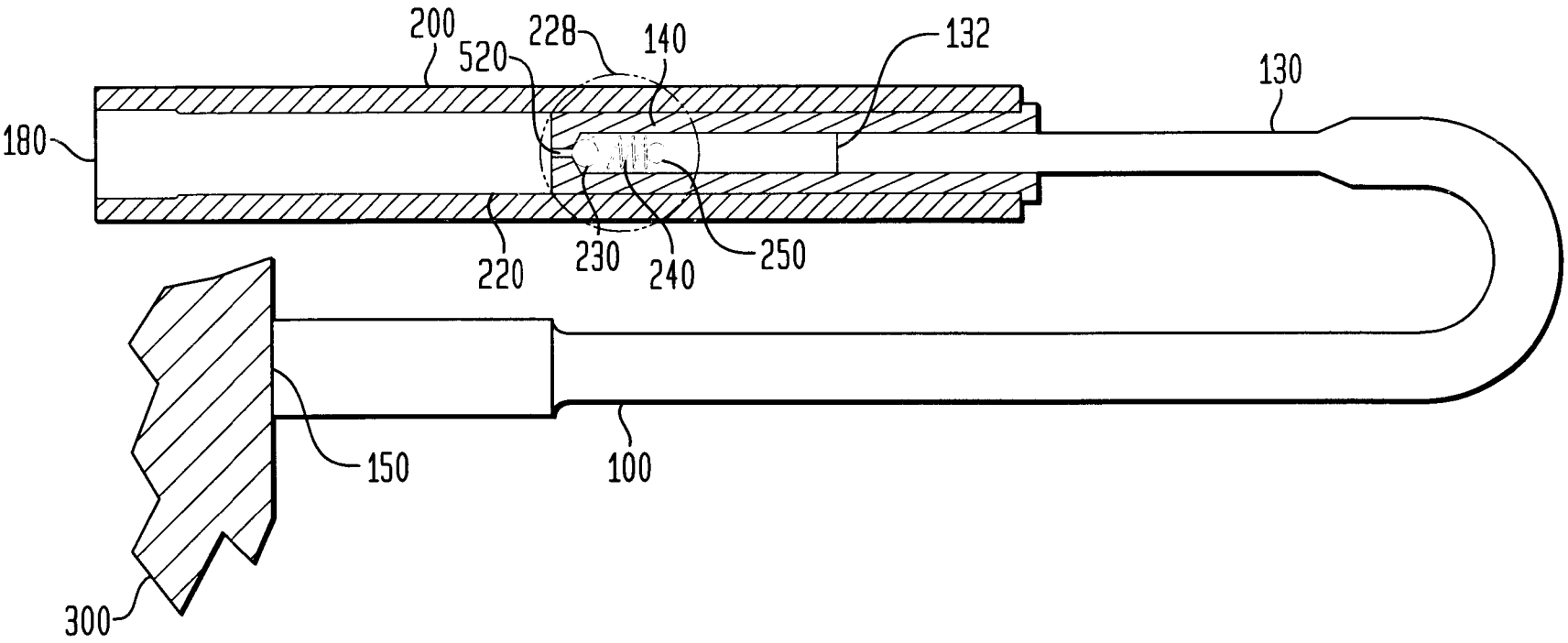

FIGS. 4 through 6 correspond to FIGS. 1 through 3, respectively, and further illustrate an additional check valve 228 comprising a vent hole 520, a check ball 230, a spring 240, and a retaining pin 250. Propellant gases within the barrel pass through the vent hole 520, forcing the check ball 230 forward against the spring 240. The propellant gases pass around the check ball 230 and pressurize the sleeve inner bore 210. As the gas pressure in the sleeve inner bore 210 approaches the level of the gas pressure in the barrel, the check ball 230 is forced rearward by the spring 240 to seal the vent hole 520, thus capturing the gas pressure within the inner sleeve bore 210. This captured gas pressure acts against the end of the piston 132, accelerating the barrel 200 away from the piston 130, thus providing the recoil operation.

Figures 7, 7A, 7B:
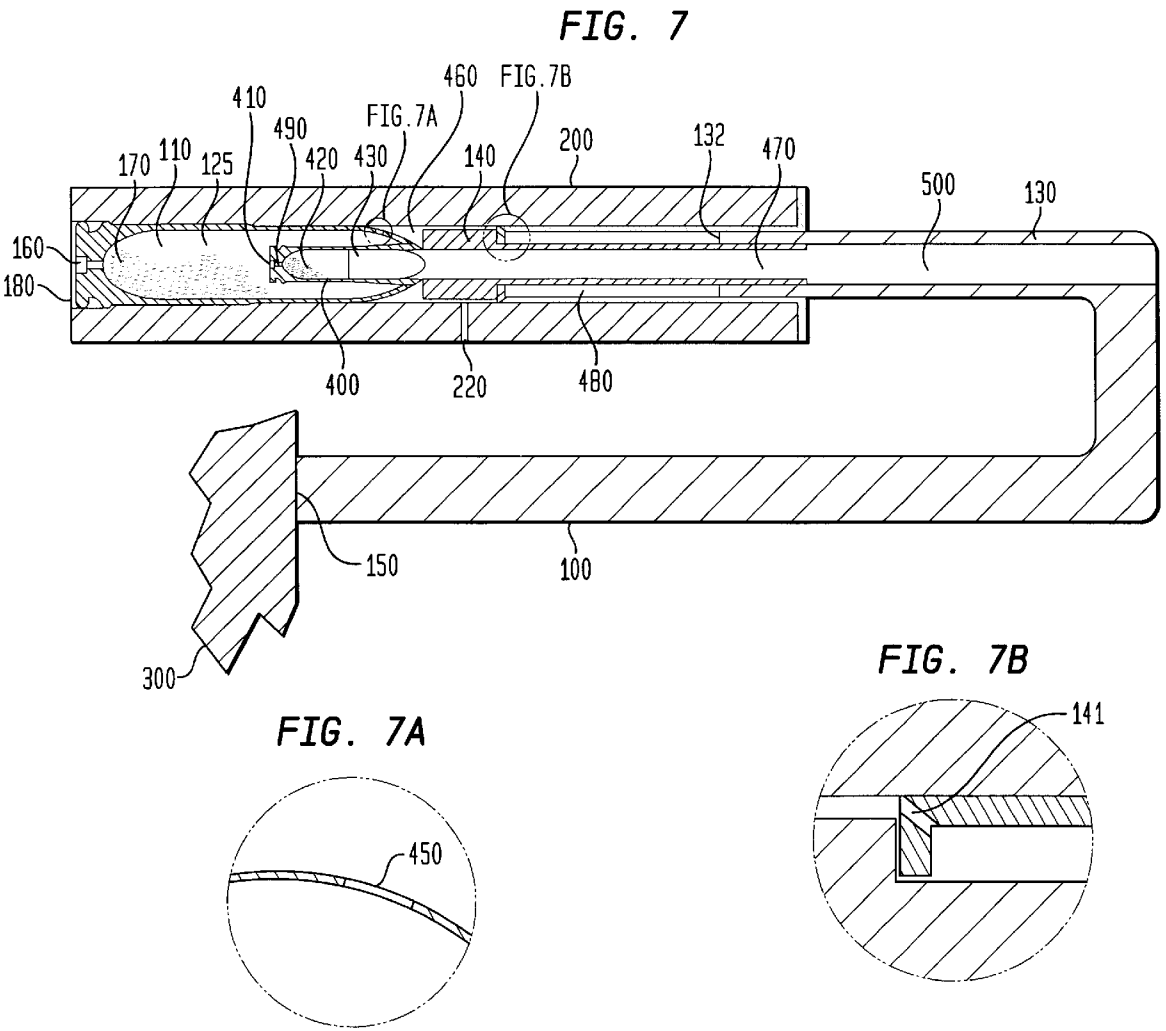
FIG. 7 is a cross-sectional, side elevational view of a low impulse adapter for firing low impulse sub-caliber projectiles from fire-out-of-battery combination gas and recoil operated weapons illustrating the barrel in the seared, ready-to-fire (rear) position.
FIGS. 7A and 7B are exploded views of various details shown on FIG. 7.
Figure 8:
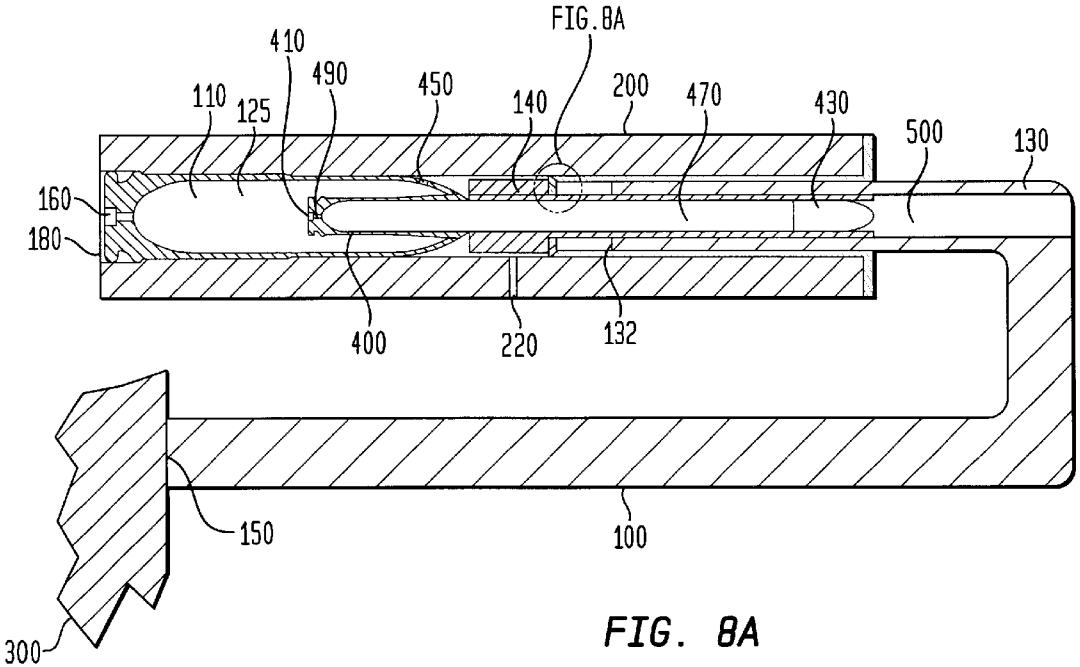
FIG. 8 is a cross-sectional, side elevational view of FIG. 7, illustrating the barrel in the fire (forward) positions.
Figure 8A:
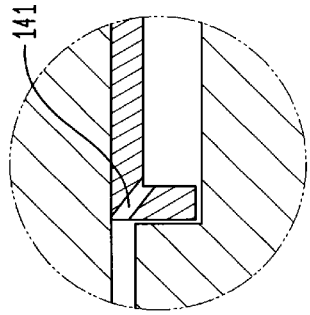
FIG. 8A is an exploded view of various details shown on FIG. 8.
Figure 9:
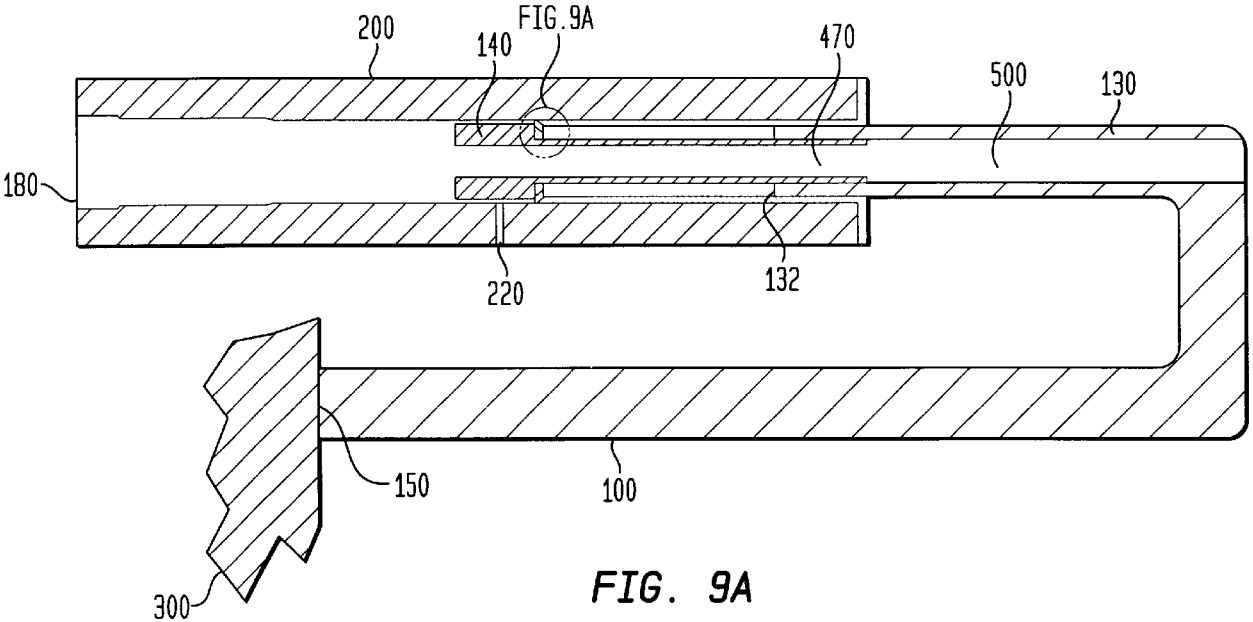
FIG. 9 is a cross-sectional, side elevational view of FIG. 7, illustrating the barrel returned to the seared, rear position.
Figure 9A:
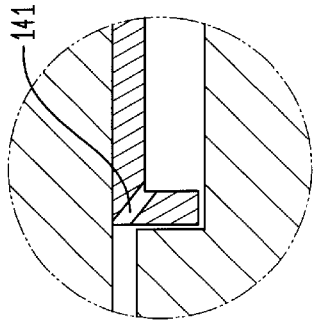
FIG. 9A is an exploded view of various details shown on FIG. 9.

FIGS. 7 through 9 are identical to FIGS. 1 through 3, respectively, and further illustrate an additional sub-caliber cartridge assembly 400 which is generally comprised of a primer 410, a propellant 420, and a projectile 430. The sub-caliber cartridge 400 is integral with the forward end of the low impulse cartridge 110. Gas vents 450 are provided in the forward end of the low impulse cartridge 110 around the periphery of the sub-caliber cartridge 400, to provide a path for the gas generated from burning propellant 170 to the gas port 220 and the adapter piston 130. The piston 130 is modified to provide a sub-caliber inner bore 470. This is accomplished by forming the piston 130 and sleeve inner bore 480 into concentric cylinder.

The sub-caliber projectile cartridge assembly 125 (i.e., the whole cartridge is chambered) is chambered in the same manner and at the same point during weapon operation as for conventional cartridges. When the firing pin strikes and ignites the primer 160, the propellant 170 ignites and burns, pressurizing the cartridge 125. Expanding propellant gas passes through the vent or vents 450 at the forward end of the cartridge 125 into the inner bore 460 of the barrel 200. Gas bleeds through the gas port 220 to power the gas system and provide gas operation. Gas also bleeds from the inner bore 460 of the barrel 200 through a gas port 141 into the inner bore 480 of the barrel sleeve 140. The net gas pressure force acting between the piston surface 132 and the barrel 200 accelerates the barrel 200 rearward away from the piston 130, providing the energy for recoil operation.

The hot, high pressure expanding propellant gas from the burning propellant 170 ignites the primer 410 in the base of the sub-caliber cartridge 400. In turn, a primer 410 of the sub-caliber cartridge 400, ignites a sub-caliber cartridge propellant 420. The expanding gases from the burning propellant 420 push against the base of a sub-caliber projectile 430, accelerating and launching the projectile 430 from a sub-caliber inner bore 470.

Alternatively, according to another embodiment, the primer 410 is omitted, and the hot, high pressure gases from the burning propellant 170 may be used to ignite the propellant 420 within the sub-caliber cartridge 400 directly.

In yet another embodiment, the primer 410 and the propellant 420 within the sub-caliber cartridge 400 are omitted, and the expanding propellant gases from the burning propellant 170 pass through a vent hole 490 and act on the base of the sub-caliber projectile 430 directly.

Figure 10:
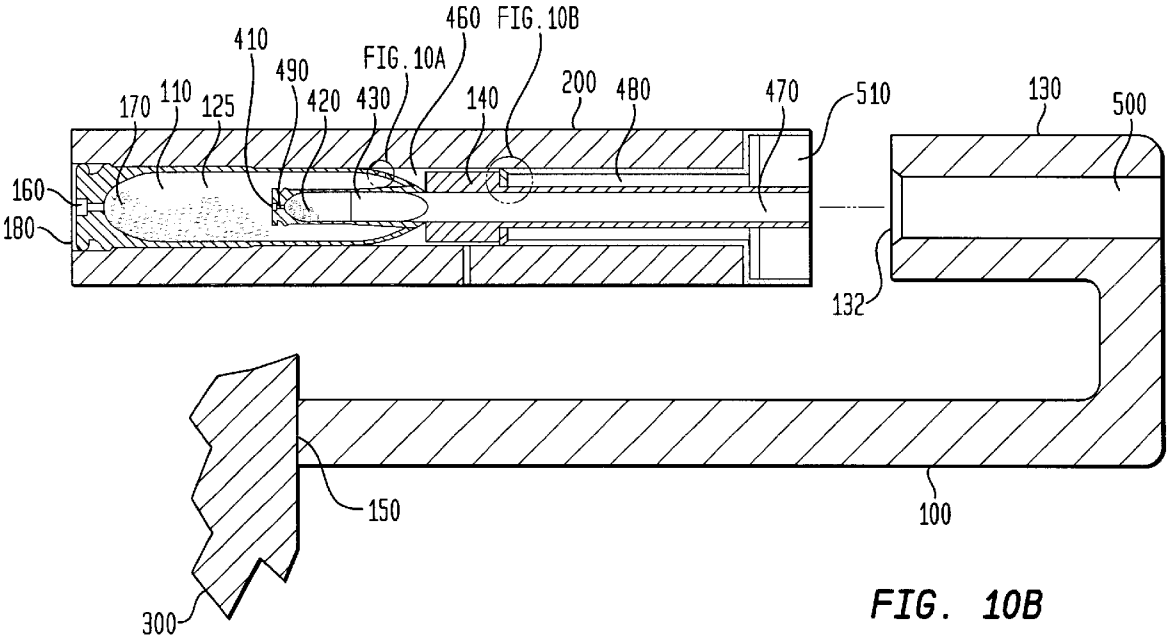
FIG. 10 corresponds to FIG. 7, with the piston moved externally to the barrel, so that the caliber of the sub-caliber projectile can be maximized, and further illustrating a valve that has been added to capture the gas pressure within the piston/cylinder portion of the low impulse firing adapter for sub-caliber projectiles.
Figure 10B:
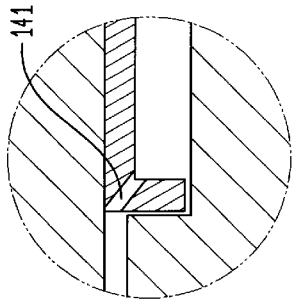
FIGS. 10A and 10B are exploded views of various shown on FIG. 10.
Figure 10A:
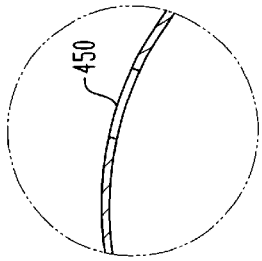

FIG. 10 corresponds to FIG. 7, except the piston 130 and the barrel sleeve 140 have been reconfigured such that the piston 130 does not enter the barrel 200. This allows the sub-caliber bore 470 to be increased to allow firing larger caliber sub-caliber projectiles 430.

FIG. 10 also shows an alternative check valve 510, in the form of a flat reed valve that allows the gas to escape from the gas passages 480 within the sleeve 140 into the cylinder 520 where the gas can interact with the end of the piston 132. The check valve 510 prevents gas from flowing from the cylinder 520 back into the gas passages 480.

FIGS. 11 and 12 illustrate a blank cartridge which is comprised of a cartridge case 115, a primer 160, and a propellant 170. The cartridge has the same external configuration as conventional cartridges used in combination gas and recoil operated weapons, to the extent necessary for reliable weapon function. A crimp or combustible seal is used to close the case mouth 117 to provide a water tight container.

FIG. 13 is a cross sectional, side elevational view of the blank cartridge with a small caliber .44 cartridge or similar blank cartridge 600. The small caliber cartridge allows the use of inexpensive small caliber cartridge loading equipment. The small caliber cartridge also provides a simple means for containing the propellant 170 in a water tight container, eliminating or reducing the need for sealing the mouth 117 of the blank cartridge 110.

Figure 14C:
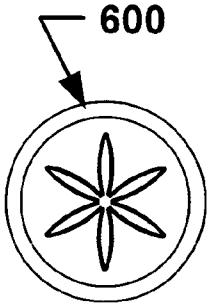
FIG. 14 is comprised of FIGS. 14A, 14B and 14C that illustrate a rear view, a side elevational view, and a front view, respectively, of a small caliber blank cartridge.
Figure 14B:
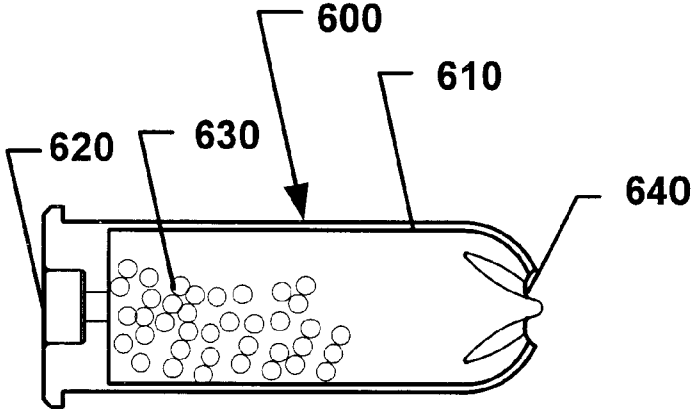
Figure 14A:
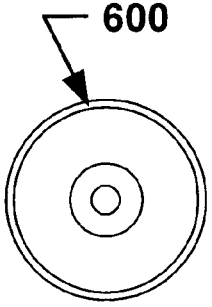

FIG. 14 is a cross sectional, side elevational view of a small caliber blank cartridge 600, comprised of a cartridge case 610, primer 620, and propellant 630. A rosette crimp 640 is shown as one means for sealing the mouth of the cartridge case.

Figure 15B:
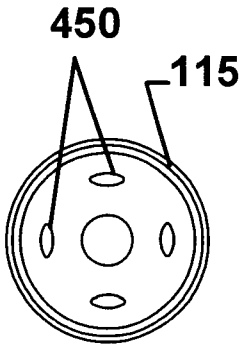
FIG. 15 is comprised of FIGS. 15A and 15B that illustrate a cross sectional, side elevational view, and a front elevational view, respectively, of a sub-caliber projectile cartridge.
Figure 15A:
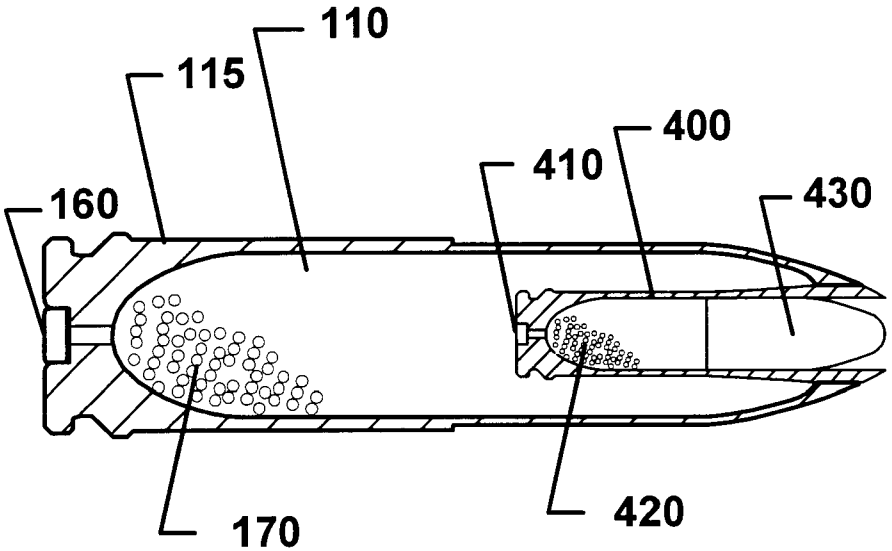

FIG. 15 is a cross sectional, side elevational view of a sub-caliber projectile cartridge 125, comprised of a cartridge case 115, primer 160, main propellant charge 170, gas vents 450, and a sub-caliber cartridge 400. The sub-caliber cartridge is shown with a primer 410, propellant 420, and projectile 430.

The sub-caliber cartridge assembly 400 is integral with the forward end of the low impulse cartridge 110. Gas vents 450 are provided in the forward end of the low impulse cartridge 110 around the periphery of the sub-caliber cartridge 400.

The embodiments described herein are included for the purposes of illustration, and are not intended to be the exclusive; rather, they can be modified within the scope of the invention. Other modifications may be made when implementing the invention for a particular application.

What is claimed is:

1. A firing adapter for adapting an existing semi-automatic or automatic gas and recoil operated weapon that includes a gas system, a receiver, a recoil mechanism, a bolt, a barrel, a feed mechanism, wherein the gas system operates the bolt and the recoil mechanism operates the feed mechanism, to fire low energy cartridges, the adapter comprising:

a sub-caliber piston having an inner diameter that is smaller than an inner diameter of the barrel;

a barrel sleeve having an outer diameter substantially equal to the inner diameter of the barrel, and an inner diameter slightly larger than the outer diameter of the sub-caliber piston;

an anchor that secures the sub-caliber piston to the receiver;

the barrel sleeve fitting within, and removably secured to the barrel;

the sub-caliber piston slidably disposed relative to the barrel sleeve to provide gas pressure needed to operate the gas system and the recoil mechanism, while reducing the force transmitted through the adapter to a desired level; and wherein the anchor provides a path for reacting the force generated by the sub-caliber piston to recoil the recoiling mechanism.

2. The firing adapter according to claim 1, further including a valve that captures gas pressure within the barrel sleeve.

3. The firing adapter according to claim 1, wherein the sub-caliber piston includes an inner bore that allows the launching of a sub-caliber projectile.

4. The firing adapter according to claim 3, wherein the sub-caliber projectile is any one or more of: a limited range training projectile, a non-lethal projectile, or a payload.

5. The firing adapter according to claim 4, wherein the payload can assume any one or more of the following configurations:

a powder, an aerosol, or a liquid.

6. The firing adapter according to claim 3, wherein the piston is external to the barrel sleeve;

wherein the barrel sleeve includes an annular gas passage that accommodates a larger caliber bore for launching a sub-caliber projectile.

7. The firing adapter according to claim 3, further including a cartridge containing a sub-caliber cartridge assembly secured to a forward end of the cartridge; and further including one or more vents in a cartridge wall in close proximity to the sub-caliber cartridge assembly.

8. An firing adapter according to claim 1, further including a blank cartridge.

9. A gas and recoil operated weapon adapted to fire low impulse cartridges, comprising:

a gas system;

a receiver; a recoil mechanism;

a bolt;

a barrel;

a feed mechanism, wherein the gas system operates the bolt and the recoil mechanism operates the feed mechanism; and an adapter comprising:

a sub-caliber piston having an inner diameter that is smaller than an inner diameter of the barrel;

a barrel sleeve having an outer diameter substantially equal to the inner diameter of the barrel, and an inner diameter slightly larger than the outer diameter of the sub-caliber piston;

an anchor that secures the sub-caliber piston to the receiver; the barrel sleeve fitting within, and removably secured to the barrel;

the sub-caliber piston slidably disposed relative to the barrel sleeve to provide gas pressure needed to operate the gas system and the recoil mechanism, while reducing the force transmitted through the adapter to a desired level; and wherein the anchor provides a path for reacting the force generated by the sub-caliber piston to recoil the recoiling mechanism.

10. The weapon according to claim 9, further including a valve that captures gas pressure within the barrel sleeve.

11. The weapon according to claim 9, wherein the sub-caliber piston includes an inner bore that allows the launching of a sub-caliber projectile.

12. The weapon according to claim 11, wherein the sub-caliber projectile is any one or more of: a limited range training projectile, a non-lethal projectile, or a payload.

13. The weapon according to claim 12, wherein the-payload can assume any one or more of the following configurations: a powder, an aerosol, or a liquid.

14. The weapon according to claim 11, wherein the piston is external to the barrel sleeve;

wherein the barrel sleeve includes an annular gas passage that accommodates a larger caliber bore for launching a sub-caliber projectile.

15. The weapon according to claim 11, further including a cartridge containing a sub-caliber cartridge assembly secured to a forward end of the cartridge; and further including one or more vents in a cartridge wall in close proximity to the sub-caliber cartridge assembly.

16. An weapon according to claim 9, further including a blank cartridge.

* * * * *